US006743963B2

(12) United States Patent
Centofanti et al.

(10) Patent No.: US 6,743,963 B2
(45) Date of Patent: Jun. 1, 2004

(54) METHODS FOR THE PREVENTION OF RADON EMISSIONS

(75) Inventors: Louis Centofanti, Atlanta, GA (US); Steve Boddeker, Gainesville, FL (US); W. Emmett Bolch, Gainesville, FL (US); George Harder, Gainesville, FL (US)

(73) Assignee: Perma-Fix Environmental Services, Inc., Gainesville, FL (US)

( * ) Notice: Subject to any disclaimer, the term of this patent is extended or adjusted under 35 U.S.C. 154(b) by 0 days.

(21) Appl. No.: 09/464,253

(22) Filed: Dec. 16, 1999

(65) Prior Publication Data

US 2002/0042552 A1 Apr. 11, 2002

Related U.S. Application Data

(60) Provisional application No. 60/113,091, filed on Dec. 21, 1998.

(51) Int. Cl.[7] ..... G21F 9/00

(52) U.S. Cl. ..... 588/6; 588/8

(58) Field of Search ..... 588/8, 2, 6, 3, 588/14, 15, 16; 524/312, 424, 437, 451; 250/506.1, 507.1; 423/262; 427/388.4

(56) References Cited

U.S. PATENT DOCUMENTS 4,077,901 A * 3/1978 Arnold et al. ..... 252/301.1 W
4,416,810 A * 11/1983 Noakes ..... 588/3
4,622,176 A * 11/1986 Motoki et al. ..... 588/2
4,839,102 A * 6/1989 Kertesz et al. ..... 252/628
4,863,638 A * 9/1989 Harper, III ..... 252/633
4,897,221 A 1/1990 Manchak, Jr.
4,980,090 A 12/1990 Manchak, Jr.
5,100,555 A * 3/1992 Matson ..... 210/651
5,169,566 A * 12/1992 Stucky et al. ..... 252/629
5,318,730 A 6/1994 Rieser et al.
5,399,603 A 3/1995 Sloan et al.
5,551,976 A * 9/1996 Allen ..... 106/696
5,732,364 A 3/1998 Kalb et al.
5,799,870 A 9/1998 Bayer

* cited by examiner

*Primary Examiner*—Stanley S. Silverman
*Assistant Examiner*—Edward M. Johnson
(74) *Attorney, Agent, or Firm*—Kilpatrick Stockton LLP

(57) ABSTRACT

This invention is directed to methods for treating radioactive-containing waste materials. Even more specifically, this invention relates to the prevention of radon emissions by encapsulating the radon in radon-generating waste matter using a chemical additive. Alternatively, the amount of radon escaping into the environment may be minimized by adjusting the shape of the carrier which stores the radon generating waste matter. Additionally, the first two embodiments may be combined to ensure that the radon does not escape into the environment. Finally, polymer sealants may be used as an additional barrier layer.

4 Claims, No Drawings

METHODS FOR THE PREVENTION OF RADON EMISSIONS

CROSS-REFERENCE TO RELATED APPLICATION

This application claims priority to U.S. Provisional Patent Application Ser. No. 60/113,091, filed Dec. 21, 1998.

FIELD OF THE INVENTION

The present invention relates, in general, to methods for treating radioactive-containing waste materials. More specifically, the present invention relates to the prevention of radon emissions. More particularly, the present invention relates to the prevention of radon emissions by encapsulating the radon in radon-generating waste matter using a chemical additive and by adjusting the shape of the carrier which stores the radon-generating waste matter.

BACKGROUND OF THE INVENTION

Radioactive materials are a major concern in the U.S. One of the more common radioactive materials is radon. Radon is a pervasive pollutant. Radon (Rn) is a naturally occurring element that is formed upon the radioactive decay of radium-226. Radon is tasteless, odorless and colorless. It exists as a gas in the form of three natural isotopes—Rn-219, Rn-220, and Rn-222. The former two isotopes have half-lives of the order of seconds and thus are of little concern. However, Rn-222 decays in a slower process that is characterized by a considerably longer half-life of 3.82 days. Radon decay proceeds with emission of alpha particle radiation through a series of solid, short-lived radioisotopes (e.g., polonium-218 and polonium-214) that are collectively referred to as radon "daughters" or progeny.

These radon daughters, which are unstable isotopes in their own right, are responsible for most of the radiation dose associated with high radon levels in the air. Most radon gas that is inhaled is generally exhaled as well because its radioactive half-life is long as compared to the residence time of the gas in the lungs. However, the above-mentioned alpha-emitting polonium isotopes are solids rather than gases, and a fraction of these radon daughters are deposited on the surfaces of the airways deep in the lung when air is inhaled. The radon progeny deposited in this manner subsequently decay by emission of short-range but slow-moving and powerful alpha particles capable of damaging cells which they encounter. This alpha radiation dose is delivered to stem cells present in the epithelium that comprises the surface of the air passages in the lungs.

Radon gas in lungs is believed to be the second leading cause of lung cancer. Early United States Environmental Protection Agency (EPA) estimates indicated that in the Unites States alone 5,000 to 20,000 lung cancer deaths a year are attributable to "natural" radon from all sources, and more recent estimates tend to be larger, e.g., between 10,000 and 40,000 lung-cancer deaths each year. Extensive surveys of radon levels in homes and schools are under way at EPA's urging, based on its finding that some 10% of the nation's homes exceed its 4 picoCuries per liter (pCi/L) action level. Congress has recently identified a long-term goal of reducing indoor radon concentrations to typical levels in the outside environment (0.1–0.7 pCi/L), and EPA is publicizing radon mitigation measures and establishing the groundwork for eventual regulations dealing with allowable levels of radon in indoor air and drinking water.

The prior art has proposed several solutions in dealing with radon and radon emissions. Most of these solutions are directed to preventing radon emissions from entering an individual's home. One such solution has been to line the floor or ground below the home with a plastic covering designed to prevent radon from entering through the ground or floor. However, these coverings only provide partial protection, and any slit or tear in the cover will permit the radon to enter the building.

U.S. Pat. No. 5,399,603 discloses attempts to overcome these deficiencies by using a polymer sealant to coat the ground or floor. While these sealants are more effective at preventing radon emissions from penetrating into the home, they suffer some of the same problems that if part of the floor or ground is not coated, the radon emissions are still able to enter through these openings.

Additionally, the above solutions are directed to preventing naturally occurring radon emissions from entering a home. Workers who work with radon-contaminated waste also need to be protected from the emissions. The choices available for preventing radon emissions from radon-generating waste matter are much more limited. U.S. Pat. Nos. 4,897,221 and 4,980,090 are directed to the treatment of radon-contaminated waste. These references admix the waste with a shielding material, such as ceramic, enamel, concrete or metal, and place the admixture into a centrifuge to mix and encapsulate the waste within the shielding material. The encapsulated waste is then placed in a vault. However, the problems with this method are that the radon emissions are still able to escape the shielding material, which is the reason these wastes are placed into a vault.

Accordingly it is an object of the present invention to provide methods useful for treating waste material containing radioactive wastes. These methods would prevent radon emissions while obviating the need for protective vaults and would permit the wastes to be formed into products that could be used without fear of harming members of the public.

SUMMARY OF THE INVENTION

The present invention is directed to methods for treating radioactive materials contained within a variety of different waste materials. More specifically, the present invention is directed to the prevention of radon emissions wherein radon-emissions are minimized by admixing the radon-generating waste with a shielding material and then forming the admixture into geometric-shaped objects which minimize the surface area of the object with respect to the volume of the object, thereby reducing any radon emissions emanating from the object.

Additionally, the radon-generating waste may be admixed with a chemical additive which encapsulates the radon. Then, the encapsulated radon is admixed with a shielding material and formed into objects. These objects may further be shaped into geometric objects having a high ratio of volume to surface area to ensure that any radon which may not be encapsulated has less area from which to leave the object.

Finally, a polymer sealant optionally may be used to further prevent radon emissions from radon-generating waste which has either been encapsulated or formed into geometric shapes or both.

Accordingly it is an object of the present invention is to provide methods useful for treating waste material containing radioactive wastes.

It is another object of the present invention to provide a method of reducing radon emissions from radon-generating wastes by adding a chemical additive to the waste to encapsulate the radon prior to admixing the radon with a shielding material.

It is another object of the present invention to provide a method of reducing radon emissions from radon-generating wastes by adjusting the geometry of the shielding material into which the radon-generating waste is placed.

It is another object of the present invention to provide a method of reducing radon emissions from radon-generating wastes by both adding a chemical additive to the waste to encapsulate the radon and adjusting the geometry of the encapsulated waste.

It is another object of the present invention to provide a method of reducing radon emissions from radon-generating wastes by further using a polymer sealant to prevent radon emissions from radon-generating wastes.

These and other objects, features and advantages of the present invention will become apparent after a review of the following detailed description of the disclosed embodiments and the appended claims.

DETAILED DESCRIPTION

Radioactive materials are located within a large variety of waste materials. As used herein, the term "radioactive" means any material that emits mass and energy during decay of the material. In particular, an example of a "radioactive material" is radium, which emits alpha particles and decays to radon. Radon is a common radioactive material and is found in a variety of different waste materials. These materials include, but are not limited to, monazite, zircon, illmenite, phosphate, china-clay and thorium processing. Radon-generating waste materials should be treated before disposing of the materials to ensure that living things coming into contact with the waste materials will not suffer any radon emission exposure.

The present invention is directed to methods for treating radon-generating waste materials to reduce and substantially prevent radon emissions from escaping from the waste materials and endangering individuals handling the waste materials. The present invention sets forth several methods by which the waste materials may be treated. One embodiment of the present invention involves admixing the waste material with a shielding material and then forming the admixture into geometric shapes having a high volume per unit surface area. Another embodiment of the present invention involves the use of chemical additives which encapsulate the radium and progenitors, thereby preventing radon emissions. Yet another embodiment of the present invention involves a combination of the first two methods. Finally, polymer sealants may be used to further prevent radon emissions from escaping the waste materials.

In a first embodiment of the present invention, radon-generating material is admixed with a shielding material and the resulting admixture is then formed into geometric shapes having a high volume per unit of surface area.

As radium particles decay, they emit alpha particle radiation and radon. Radon, as a gas, can escape the waste material and become an airborne hazard. Therefore, shielding materials have been used wherein the shielding material help prevent radon from escaping the shielding material. However, these shielding materials will still permit some radon to escape into the environment. The amount of radon escaping can be minimized by forming the admixture of the radon-generating waste material and the shielding material into geometric shapes that minimize surface area per unit volume. Therefore, the area through which the radon may pass is minimized while still permitting large amounts of waste material to be treated.

In general, the shapes used should minimize surface area per unit volume. These shapes include, but are not limited to, generally spherical shapes and generally cubic shapes. However, any geometric shape that minimizes the following equation will suffice in the present invention:

$$\text{volume}/(\text{surface area}\times 2)$$

As discussed above, the radon-generating material is preferably admixed with a shielding material prior to forming the material into geometric shapes. By "shielding material" it is meant any material that impedes or prevents radon from passing through the material. The shielding material is selected to provide a matrix within which the waste material is incorporated such that any radon must first pass through the matrix of the shielding material before it can escape into the environment. The shielding material should also be selected based upon its ability to act as a barrier for radon. Examples of shielding materials useful in the present invention include, but are not limited to, ceramic, enamel, concrete or metal.

The radon-generating waste material and the shielding material may be admixed using any device capable of ensuring that the waste material will be thoroughly admixed and incorporated within the matrix of the shielding material. By "incorporated" it is meant that the waste material or polymer/waste material admixture is located within the matrix of cell walls of the shielding material such that the cell walls impede or prevent radon from passing through the cell walls or matrix of the shielding material. Examples of mixing devices useful in the present invention include, but are not limited to, centrifugal mixers and static mixers, among others.

The amount of shielding material used should be sufficient to fully incorporate the waste material within the matrix of the shielding material. In general, it is preferred that the ratio of the amount of shielding material to the amount of waste material is at least about 2 to 1. More preferably, the ratio is at least about 3 to 1 and even more preferably, the ratio is about 4 to 1. These ratios ensure that the waste material will be fully incorporated within the shielding material.

In a second embodiment of the present invention, a chemical additive is admixed with radon-generating waste material. The additive is chosen such that the additive encapsulates the radon, thereby preventing radon emissions from escaping from the waste material. The waste material may then be admixed with a shielding material to embed the radon-generating waste material within the matrix of the shielding material. The shielding material may then be disposed of by any process known in the art.

The additive materials useful in the present invention are selected to be capable of encapsulating the material such that the radon is enclosed within the additive. The additive material then prevents radon radiation from escaping through the additive, thus preventing someone working with the encapsulated material from being exposed to the dangerous radiation. Examples of chemical additives useful in the present invention include, but are not limited to, mineral oil, charcoal, activated carbon, silicates, sulfur, organic and inorganic polymers.

The amount of the additive material admixed with the radon-generating waste material is dependent on the type of waste material and the potential amount of radon contained within the waste material. In general, it is preferred that the amount of additive should at least be sufficient to encapsulate the radon existing in the waste material. Preferably, an excess amount of the additive is added to ensure that all of the radon remains encapsulated. Additionally, depending upon the types of waste, some wastes may contain more radon than other wastes. For example, since soil contains radium, wastes containing soil will have higher radon emissions. In general, the additive should be added in an amount of from about 0.1 to about 50 percent by weight of the waste material. More preferably, the amount of additive added is from about 10 to about 30 percent by weight of the waste material.

Radon has a half-life of 3.8 days. By slowing its movement through the matrix, less radon is emitted to the atmosphere. Methods to slow the movement may include adhering the radon to other particles or increasing the linear path to the environment. In operation, the additive material is admixed with the waste material in any known mixing device. The additive then surrounds and encapsulates any radon, thereby preventing alpha particles from escaping through the additive material. By "encapsulates" it is meant that the radon is substantially or totally enclosed within the chemical additive. Without the additive material, radon would pass through the waste material and any shielding material and into the environment where they could be inhaled by an individual working with the waste.

In a third embodiment of the present invention, the method comprises a combination of the first two embodiments. First, the radon-contaminated waste material is admixed with a chemical additive material designed to encapsulate the radon within the polymer. Next, the encapsulated waste material is admixed with a shielding material to incorporate the encapsulated waste within the matrix of the shielding material. Then, the admixture is formed into a geometric shape having a low surface area per unit volume.

Radon-generating waste materials which have been treated by any one of the previous embodiments may be further disposed of by any known means of disposal. However, one advantage of the chemical additive encapsulation embodiments is that these waste materials may, after the radon has been encapsulated, be used in building materials, especially when the shielding material is concrete. The waste material/shielding material admixture may be formed into slabs, or more preferably cubes, and used in buildings. Since the radon has been encapsulated, there is no problem with radon emissions thereby permitting these building materials to be used without causing harm to individuals contacting these building materials.

Optionally, in each of the above embodiments, a polymer sealant may be used as a further treatment step. The polymer sealant may be applied to the surface area of the radon-generating waste after the waste has been encapsulated within a chemical additive to provide an additional barrier against radon. Additionally, the polymer sealant may be applied to the surface of an admixture of radon-generating waste material and a shielding material, again as an additional barrier against radon.

The types of polymer sealants used are those which provide an effective barrier to radon emissions. Examples include sulfopolymer-acrylic copolymer blend emulsions, acrylic acid mixtures having a thixotropic agent, vinyl-acetate-ethylene copolymer mixtures having a thixotropic agent, and vinyl chloride copolymers having a thixotropic agent. These polymer sealants are added in an amount effective to thoroughly coat the surface area of the waste material or waste material/shielding material admixture such that any radon that may get to the surface area is prevented from escaping to the environment where they may harm an individual.

Those skilled in the art will recognize that the present invention is capable of many modifications and variations without departing from the scope thereof. Accordingly, the detailed description set forth above is meant to be illustrative only and are not intended to limit, in any manner, the scope of the invention as set forth in the appended claims.

We claim:

1. A method for preventing alpha particle radiation emissions from being emitted from radioactive material-containing waste material into an environment comprising:

forming a first admixture by admixing with the waste material a polymer selected from the group consisting of mineral oil, charcoal, activated carbon, and sulfur, wherein the polymer encapsulates the radioactive material within the polymer and prevents alpha particle radiation emissions from passing through the polymer, admixing the first admixture with a shielding material selected form the group consisting of ceramic, enamel, concrete, and metal, wherein the first admixture is incorporated with the second admixture, and forming the second admixture into a geometric shape selected from the group consisting of a spherical shape, and a cubic shape, wherein the radioactive material is radon, the polymer is added in an amount of about 0.1 to about 30 percent by weight based on the amount of waste material, and the ratio of the shielding material to polymer-waste material admixture is about 4 to 1.

2. The method of claim 1, wherein the radioactive material is radon.

3. The method of claim 1, further comprising applying a polymer sealant to an exterior of the chemical additive/waste material admixture to further prevent alpha particles from being emitted into the environment.

4. The method of claim 1, wherein the amount of shielding material admixed with the chemical additive-waste material admixture is in a ratio of from about 2 to 1.

* * * * *